US005191874A

United States Patent [19]

McWilliams

[11] Patent Number: 5,191,874

[45] Date of Patent: Mar. 9, 1993

[54] HEAVY GAS, INCLUDING RADON GAS, EXPELLER ASSEMBLY

[76] Inventor: Oliver B. McWilliams, 2748 Fawn Grove Ct., Colorado Springs, Colo. 80906

[21] Appl. No.: 714,448

[22] Filed: Jun. 13, 1991

[51] Int. Cl.[5] ..... F24F 7/00

[52] U.S. Cl. ..... 126/312; 454/909; 237/48

[58] Field of Search ..... 98/31.6, 33.1, 34.6, 98/42.02, 42.19, 48; 126/312; 237/46, 47, 48

[56] References Cited

U.S. PATENT DOCUMENTS

| | | | |
|---|---|---|---|
| 849,346 | 4/1907 | Abbott | 98/48 X |
| 1,169,661 | 1/1916 | McKeever | 98/48 X |
| 1,734,449 | 11/1929 | Smith | 98/42.06 |

FOREIGN PATENT DOCUMENTS

| | | | |
|---|---|---|---|
| 979945 | 5/1951 | France | 98/42.02 |

*Primary Examiner*—Harold Joyce
*Attorney, Agent, or Firm*—Phillip A. Rein

[57] ABSTRACT

A heavy gas expeller assembly to be connected to a furnace assembly to collect, direct, and expel harmful heavy gases and fluids, including radon gas, from adjacent a support floor. The heavy gas expeller assembly includes 1) a gas collector duct member connected to an exhaust gas duct assembly from the furnace assembly; and 2) an outside air inlet duct member to transfer fresh outside air into a return air duct member connected to the furnace assembly to replace the air and heavy gases that are to be expelled through an exhaust fluid duct assembly connected to the furnace assembly.

6 Claims, 1 Drawing Sheet

HEAVY GAS, INCLUDING RADON GAS, EXPELLER ASSEMBLY

Figure 1:
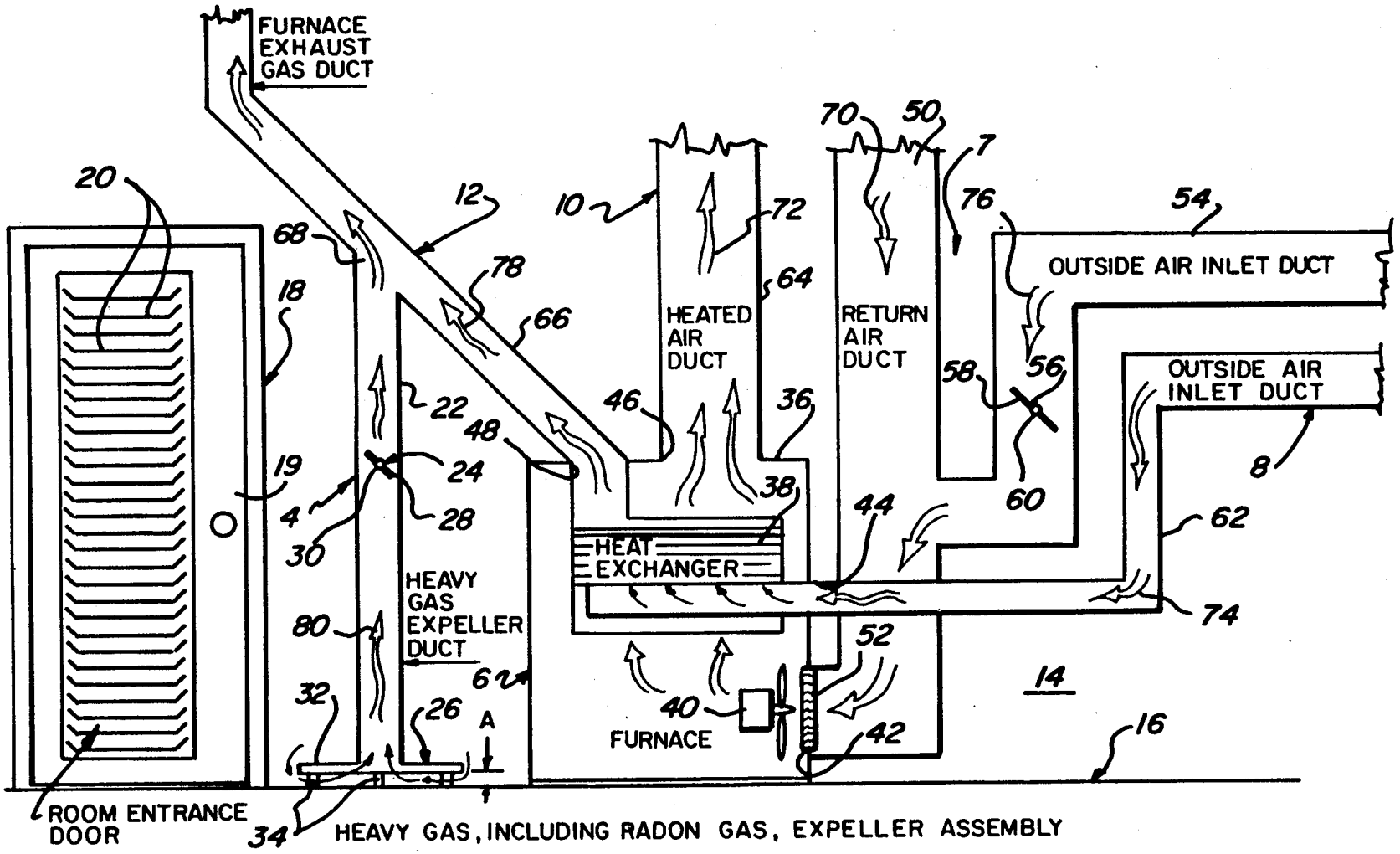

The heavy gas expeller assembly includes 1) a gas or fluid collector duct member interconnected to a collector inlet air assembly mounted on a support floor; and 2) an outside air inlet duct member to transfer outside air into a return air duct member connected to the furnace assembly.

The gas collector duct member includes an adjustable collector flow control member to regulate amount of air flow therethrough.

The outside air inlet duct member has an adjustable flow control member to regulate amount of outside air flow therethrough.

The collector inlet air assembly is operable to receive and transfer inlet air adjacent the support floor which may contain heavy gases such as radon gas. The flow is regulated through the collector flow control member so that it is exhausted with exhaust gases from the furnace assembly to provide a continuous discharge of the heavy gas from a floor area.

The heavy gas expeller assembly is operable through vacuum air pressure created by the operation of the furnace assembly as heated exhaust gases move upwardly through the exhaust duct assembly.

The air and heavy gases expelled through the gas expeller assembly are replaced by inlet air from the outside air inlet duct member so as to maintain proper atmospheric conditions within the complete structure.

OBJECTS OF THE INVENTION

One object of this invention is to provide a heavy gas expeller assembly which is connected to a furnace assembly in order to gather and expel heavy gases such as radon gas from an adjacent lower floor area.

Another object of this invention is to provide a heavy gas expeller assembly to collect heavy gas and air adjacent a floor area and transfer the same upwardly and outwardly from a building structure and having an outside inlet air duct member to replace the heavy gas and air being discharged.

One other object of this invention is to provide a heavy gas expeller assembly operable to collect harmful heavy gas, such as radon gas, and discharge same from a building structure in an efficient and effective manner without requiring the use of an energy source.

One further object of this invention is to provide a heavy gas expeller assembly which is operable to collect gas and/or air adjacent a floor surface for conjoint discharge with exhaust gases from a furnace assembly which creates a vacuum pressure thus achieving discharge of harmful gases without electrical motors, solenoids, fans, and other equipment which requires periodic maintenance and replacement.

Another object of this invention is to provide a heavy gas expeller assembly operable to collect and discharge air and/or heavy gas from a support floor and replace the discharged mixture with outside inlet air and being automatically operable to achieve this desired end result.

Still, another object of this invention is to provide a heavy gas expeller assembly that distributes fresh air that has been filtered and heated throughout the house or office complex. This fresh air distribution method eliminates the discomfort of cold window drafts at times when fresh outside air is necessary or desirable.

Still, one other object of this invention is to provide a heavy gas expeller assembly which can be connected to a conventionally available furnace assembly in a building structure requiring a minimum amount of skill to install; being of low cost to manufacture without moving parts; being substantially maintenance free; and being economical to operate.

Various other objects, advantages, and features of the invention will become apparent to those skilled in the art from the following discussion, taken in conjunction with the accompanying drawings, in which:

FIGURES OF THE INVENTION

FIG. 1 is a cross sectional view of an enclosed room assembly having a furnace assembly therein and illustrating a heavy gas expeller assembly of this invention connected thereto.

The following is a discussion and description of preferred specific embodiments of the heavy gas expeller assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a heavy gas expeller duct assembly of this invention, indicated generally at 4, is mounted in an enclosed room assembly 14 and interconnected to a high efficiency furnace assembly 6 which, in turn, is connected to i) a return and outside air duct assembly 7; 2) an efficiency outside air duct assembly 8; 8) a heated air duct assembly 10; and 4) a furnace exhaust gas duct assembly 12.

The enclosed room assembly 14 includes a support floor 16 and an access door assembly 18.

The access door assembly 18 includes a door member 19 having air flow louvers 20 extended substantially the height of the door member 19 to permit free flow of air into the enclosed room assembly 14.

The heavy gas expeller duct assembly 4 includes 1) a gas or fluid collector duct member 22; 2) a collector flow control member 24 mounted in the collector duct member 22; and 3) a collector inlet air or fluid assembly 26 connected to a lower end of the gas collector duct member 22.

The collector flow control member 24 includes a rotatable dampener member 28 connected to a support shaft 30 for rotation thereabout.

The collector inlet air assembly 26 includes an inlet disk member 32 connected to spaced support members 34 mounted on the support floor 16. The distance between a lower peripheral edge of the inlet disk member 82 and the support floor 16 is indicated by a letter "A".

The distance "A" is preferrably not more than three (3) inches and best results are obtained with distance "A" being 1½ inches.

The furnace assembly 6 includes 1) a furnace heater housing 36; and 2) a heat exchange assembly 38 and a return air fan assembly 40, both mounted in the furnace heater housing 86.

The furnace heater housing 36 includes 1) a return air duct opening 42; 2) an efficiency outside air opening 44; 3) a L heated air duct opening 46; and 4) an exhaust gas duct opening 48.

The return and outside air duct assembly 7 includes 1) a return air duct member 50: 2) a filter member 52 mounted on the return air duct opening 42 to the furnace heater housing 36; 3) an outside air inlet duct member 54 connected to the return air duct member 50; and 4) a flow control member 56 mounted in the outside air inlet duct member 64.

The flow control member 56 is a conventional dampener structure having a rotatable dampener member 58 mounted on a support shaft 60.

The efficiency outside air duct assembly s consists of an outside air duct member 62.

The heated air duct assembly 10 consists of a heated air duct member 64.

The furnace exhaust gas duct assembly 12 consists of a flue duct member 66 having an inlet expeller opening 68. The inlet expeller opening 68 receives an upper end of the gas collector duct member 22 mounted therein.

It is obvious that all of the duct members are of enclosed circular shape constructed of sheet metal as used in heating and air conditioning systems. The diameters of the duct members may vary as required by cubic volume of areas serviced by the heating and air conditioning system.

USE AND OPERATION OF THE INVENTION

In the use and operation of the heavy gas expeller duct assembly 4 of this invention, it is to be noted that it can be readily attached and adapted to a previously installed furnace assembly 6 requiring minimum skill and expense to do so. The furnace assembly 6 can be of any forced air type but is illustrated as a high efficiency type receiving outside air through the outside air duct member 62 to heat exchange assembly 88 as noted by an arrow 74. With a standard furnace, the outside air inlet duct 62 is eliminated. With a high efficiency furnace, the air inlet duct 84 may be eliminated if desired.

The furnace assembly 6 receives return air from the return air duct member 50 through the filter member 52 aided by the return air fan assembly 40 as noted by an arrow 70 The outside air is concurrently conveyed with the return air on operation of the return air fan assembly 40. The return air plus the outside fresh air is heated by the heat exchange assembly 38 and distributed through the heated air duct assembly 10 as noted by an arrow 72.

The heated exhaust gases from the furnace assembly 6 is directed out the flue duct member 66 as noted by an arrow 78.

A first installation step would be the mounting of the heavy gas expeller duct assembly 4 within the enclosed room assembly 14 preferrably adjacent the furnace assembly 6. The gas collector duct member 22 is connected to the flue duct member 66 at the inlet expeller opening 68.

The inlet disk member 32 is mounted adjacent the support floor 16 on the support members 34.

At this time, the collector flow control member 24 can be adjusted as required through the rotatable dampener member 28 to regulate the flow therein as noted by an arrow 80.

The outside air inlet duct member 54 is connected to the return air duct member 50. The flow of air in the outside air inlet duct member 54 as indicated by an arrow 76 is regulated through adjustment of the flow control member 56.

In the operation of the heavy gas expeller duct assembly 4, it is noted that energizing of the furnace assembly 6 achieves an upward flow of exhaust gases in the flue duct member 66.

Concurrently, a vacuum pressure is created in the gas collector duct member 22 which causes air flow through the collector inlet air assembly 26 as shown by the arrow 80. This fluid inlet flow would collect any heavier-than-air gas materials adjacent the support floor 16 for movement upwardly in the flue duct member 66 for discharge into the atmosphere.

The distance "A" between the inlet disk member 82 and the support floor 16 may be adjustable to create the desired air flow and efficiency. A distance "A" of 1½ inches has been found to be preferable.

The heavy gas expeller duct assembly 4 of this invention is easily installed with a minimum amount of skill and labor required to the furnace assembly 6; being economical to manufacture and operate; and substantially maintenance free.

The heavy gas expeller assembly provides means for expelling heavy gases which may be harmful, such as radon gas, which has been indentified as a potential danger to persons from a normally lower area in a residence in order to provide a healthy living environment for the persons therein.

Additionally, the heavy gas expeller assembly is operable to introduce outside fresh air into the home or the office complex which provides a healthful environment by the continuous discharge of harmful elements such as radon gas and contaminated or stale air therefrom.

The outside air inlet duct may be eliminated, if desired, when a high efficiency furnace is utilized.

While the invention has been described in conjunction with preferred specific embodiments thereof, it will be understood this description is intended to illustrate and not to limit the scope of the invention, which is defined by the following claims:

I claim:

1. A heavy gas expeller assembly connected to a furnace assembly to remove air and/or heavy gas, including radon gas, adjacent a support floor, comprising:

a) a fluid collector duct member connected in a sealed, fluid flow manner at one end to an exhaust flue duct member from the furnace assembly at an opposite end to a collector inlet assembly positioned adjacent the support floor; and b) an outside air inlet duct member connected to and supplying fresh inlet air to a return air duct and pulled through a filter member by a return air fan assembly in the furnace assembly for positive fluid flow discharge of a mixture of return air and outside fresh air throughout a building structure;

whereby a vacuum is created in said fluid collector duct member to receive fluid from said collector inlet assembly for subsequent discharge from the exhaust fluid duct member.

2. A heavy gas expeller assembly as described in claim 1, including:

a) a collector flow control member mounted in said fluid collector duct member to regulate and adjust the fluid flow therethrough and b) an outside air inlet duct member connected to a return air duct on the furnace assembly to supply fresh outside air thereto; and c) said outside air inlet duct member having a flow control member therein to regulate and adjust the air flow therethrough;

whereby the outside fresh air flow replaces the fluid flow through said fluid collector duct member and inside air that is burned and exhausted to provide replacement air thereto to maintain desired pressure conditions within a building structure having the furnace assembly therein.

3. A heavy gas expeller assembly as described in claim 1, wherein:

a lower periphery of said collector inlet assembly positioned a distance of not more than one and one-half inch inches above the support floor whereby substantial air flow is created about said collector inlet assembly.

4. A heavy gas expeller assembly as described in claim 1, wherein:

a) said outside air inlet duct member having a flow control member adjustable to regulate fresh air flow therethrough; and b) said fluid collector member having a collector flow control member adjustable to regulate fluid flow therethrough;

whereby said flow control member and said collector flow control member are collectively adjusted to balance the fluid flow discharged from said fluid collector duct member with the fresh air flow through said outside air inlet duct member.

5. A heavy gas expeller assembly as described in claim 1, wherein:

a) said collector inlet assembly having an inlet disk member extended outwardly from said fluid collector duct member to increase the are of inlet fluid flow while positioned adjacent the support floor.

6. A heavy gas expeller assembly as described in claim 1, wherein:

a) a lower periphery of said collector inlet assembly positioned a distance of not more than two inches above the support floor whereby substantial air flow is created about said collector inlet assembly.

* * * * *

UNITED STATES PATENT AND TRADEMARK OFFICE

CERTIFICATE OF CORRECTION

PATENT NO. : 5,191,874

DATED : March 9, 1993

INVENTOR(S) : Oliver B. McWilliams

It is certified that error appears in the above-identified patent and that said Letters Patent is hereby corrected as shown below:

Column 2, line 35, delete "8)" and insert therefore... 3)...;

line 57, delete "82" and insert therefore... 32...; and line 64, delete "86" and insert therefore... 36....

Column 3, line 7, delete "64" and insert therefore... 54...;

line 35, delete "88" and insert therefore... 38...; and line 38, delete "84" and insert therefore... 54....

Claim 5, line 5, delete "are" and insert therefore... area....

Signed and Sealed this

Twenty-eighth Day of December, 1993

*Attest:*

Bruce Lehman

BRUCE LEHMAN

*Attesting Officer*

*Commissioner of Patents and Trademarks*